United States Patent [19]

Kataoka

[11] Patent Number: 4,767,077

[45] Date of Patent: Aug. 30, 1988

[54] SUPPORT SHAFT FOR WINDING/UNWINDING SHEETS

[76] Inventor: Hiroshi Kataoka, 3686, Sangawacho, Iyomishima-shi, Ehime 799-04, Japan

[21] Appl. No.: 140,920

[22] Filed: Dec. 24, 1987

Related U.S. Application Data

[63] Continuation of Ser. No. 825,645, Feb. 3, 1986, abandoned.

[51] Int. Cl.[4] ..... B65H 75/24; B23B 31/40

[52] U.S. Cl. ..... 242/68.2; 242/72 R; 242/72 B; 279/2 R; 279/2 A

[58] Field of Search ..... 242/72 R, 72 B, 68.2, 242/56.9, 46.4; 279/2 R, 2 A; 269/48.1

[56] References Cited

U.S. PATENT DOCUMENTS

| | | | |
|---|---|---|---|
| 2,561,745 | 7/1951 | Lerch | 242/72 R |
| 3,593,938 | 7/1971 | Watt | 242/72 R |
| 3,817,468 | 6/1974 | Smolderen et al. | 242/72 B X |
| 3,917,187 | 11/1975 | Damour | 242/72 B |
| 3,963,250 | 6/1976 | Flagg | 279/2 R |
| 4,496,114 | 1/1985 | Kataoka | 242/72 R X |
| 4,519,620 | 5/1985 | Keith | 279/2 R |

FOREIGN PATENT DOCUMENTS 61-12558 1/1986 Japan .

*Primary Examiner*—David Werner

*Attorney, Agent, or Firm*—Oblon, Fisher, Spivak, McClelland & Maier

[57] ABSTRACT

A support shaft for winding/unwinding sheets comprises a ring with the outer periphery thereof formed with a plurality of inclined grooves circumferentially spaced apart and with the bottoms of the inclined grooves inclined in the circumferential direction, rollers accommodated in respective inclined grooves for rolling in the longitudinal direction thereof to progressively increase the extent of projection therefrom with rotation of the ring, and an outer ring with a gap surrounding the ring with rollers.

10 Claims, 11 Drawing Sheets

FIG. 6
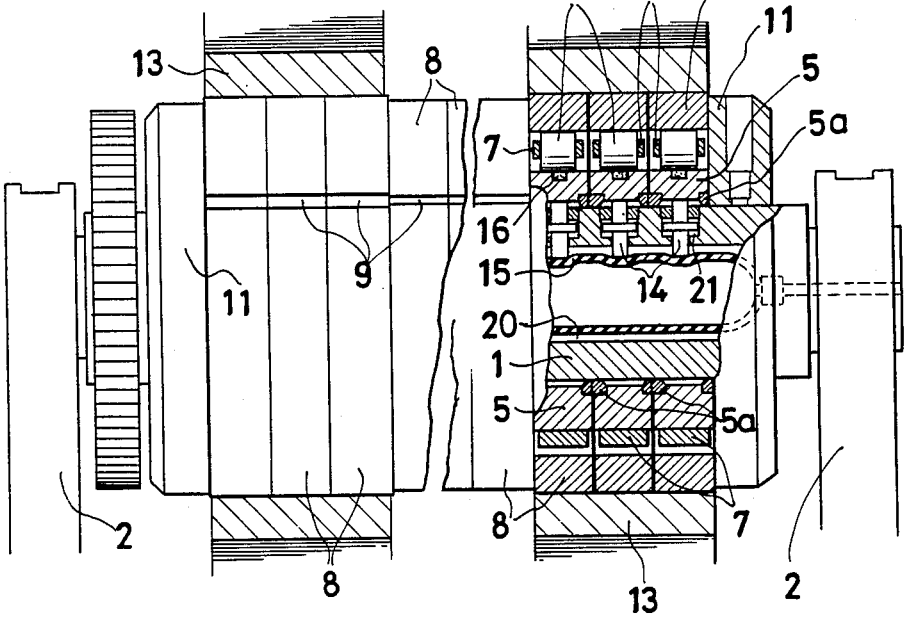
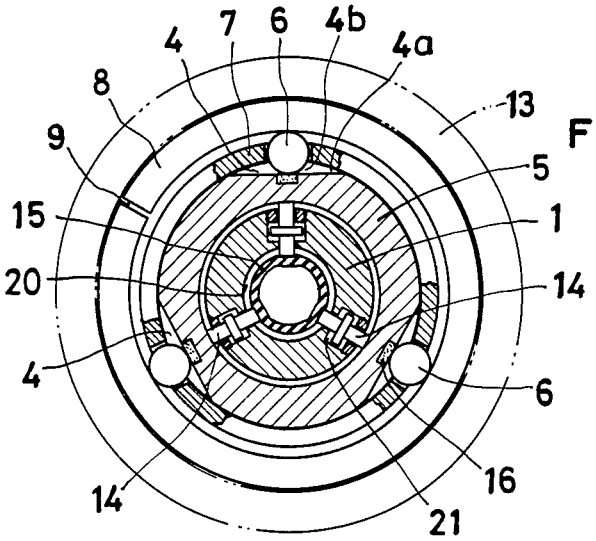
FIG. 7

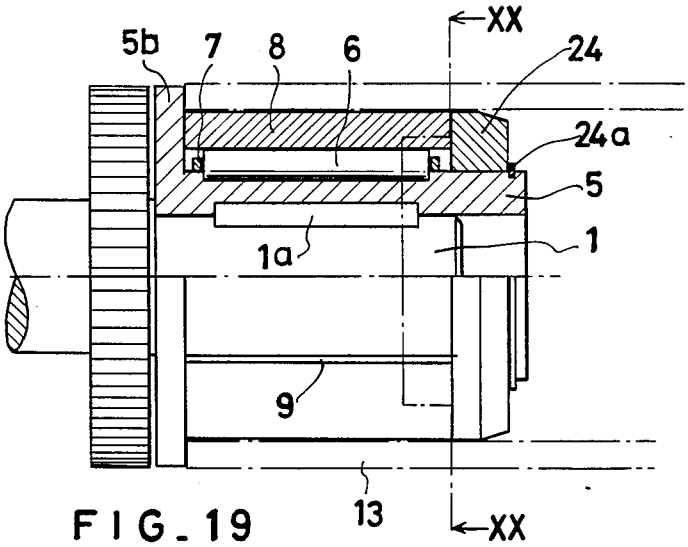
FIG. 19
FIG. 20
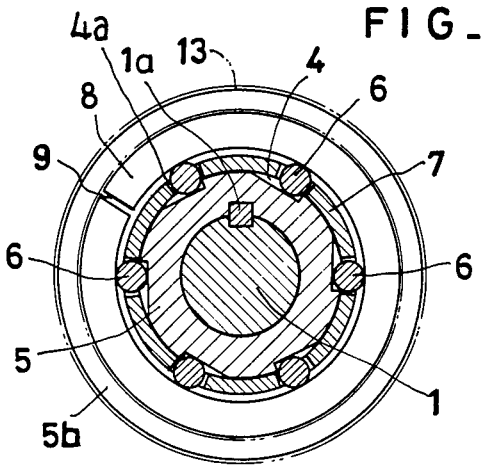

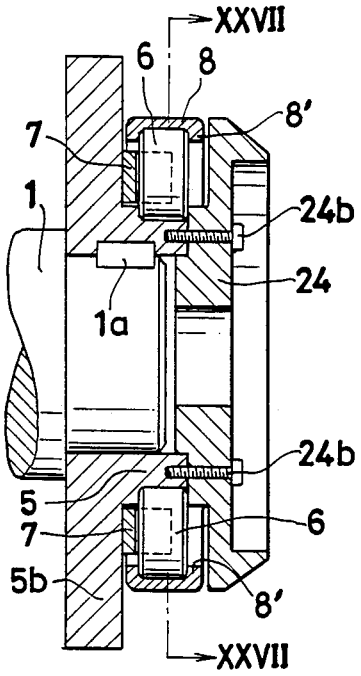
FIG. 26
FIG. 25
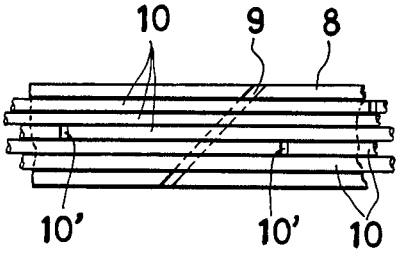
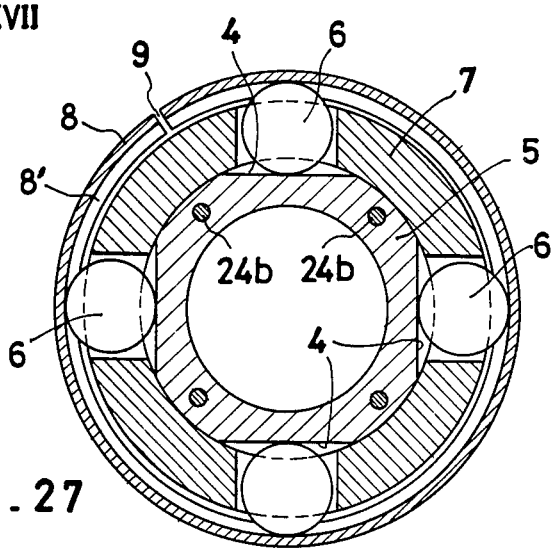
FIG. 27

SUPPORT SHAFT FOR WINDING/UNWINDING SHEETS

This application is a continuation of application Ser. No. 825,645, filed on Feb. 3, 1986, now abandoned.

FIELD OF THE INVENTION

This invention relates to a support shaft for winding-/unwinding sheets, e.g., plastic films, metal foils or thin sheets, etc.

BACKGROUND OF THE INVENTION

In the Japanese laid-open application No. 6,112,558, published Jan. 20, 1986, the inventor has previously proposed a drive shaft for taking up sheets, which comprises a shaft, the outer periphery of which is formed with a plurality of inclined grooves circumferentially spaced apart and having the bottoms thereof inclined in the circumferential direction, rollers each accommodated in the inclined grooves so as to be capable of rolling in the longitudinal direction thereof, a plurality of sector-like members arranged side by side to surround the shaft inclusive of the rollers, and expansible retaining members retaining the sector-like members such that the sector-like members can be shifted radially outwardly. The sector-like members constitute the shaft, on which a sheet to be taken up is directly wound one or a plurality of turns, or on which a core for taking up a sheet thereon is fitted. The shaft is then rotated in a direction to cause the rollers to roll along the inclined grooves toward shallow portions thereof and thus project therefrom, thereby causing a radially outward shift of the sector-like members into tight engagement with the inner periphery of the wound sheet section or core for rotation in unison therewith so that the sheet is taken up.

This drive shaft has no problem so far as it is rotated in unison with the wound sheet section or core for taking up the sheet. However, since a plurality of sector-like members are arranged side by side to surround the inner shaft and the rollers, troublesome steps are required for its machining and assembly. More specifically, a set of sector-like members is prepared by preparing a ring-like material finished to a desired size using a lathe or the like and then radially precision-cutting the ring-like material into equal sector-like divisions with very narrow cutting gaps between the adjacent divisions. It requires a great deal of care on the part of the worker to accurately fix the ring-like member or sector-like divisions firmly to a vise or the like in a cutting posture and in a state such that the member or divisions will not be deformed. Further, it is necessary to machine the sector-like divisions to form recesses for accommodating the retaining members therein. Furthermore, the expansible retaining members have to be accommodated in the recesses formed in the machined sector-like divisions, (i.e., sector-like members), after setting these members on the outer periphery of the shaft. Where piano wires are used as the expansible retaining members to be accommodated in the recesses formed in the sector-like members on either inner or outer sides thereof, for example, some of the piano wires or some of the sector-like members are liable to detach during the work of retaining all sector-like members. Therefore, the assembling operation is very troublesome and time-consuming. Further, the retaining members are liable to detach during rotation of the drive shaft. Where the retaining members are bonded to the sector-like members, the bonding work has to be done very carefully lest the bonded retaining members should be detached. Furthermore, piano wires or steel springs used as the retaining members lead to machining difficulties although they can ensure excellent durability. Further, with the conventional continuously straight surface or curved inclined surface having no corrugation, it is difficult to temporarily lock the wound sheet or core which has already been set in position on the drive shaft.

OBJECT OF THE INVENTION

An object of the invention is to provide a support shaft which can be manufactured by easy machining and assembly and can reliably lock the sheet winding section or core because it comes into contact at its entire circumference with the inner periphery of the section or core during its rotation to form the section or core substantially in the shape of a true circle, whereby a sheet can be wound on or unwound from the section or core.

SUMMARY OF THE INVENTION

To attain the above object of the invention, there is provided a support shaft for winding/unwinding sheets, which comprises a shaft having the outer periphery thereof provided with a plurality of inclined grooves which are circumferentially spaced apart and have the bottoms thereof inclined in the circumferential direction, rollers each accommodated in each inclined groove for rolling in the longitudinal direction thereof from a deep portion toward a shallow portion thereof to progressively increase the extent of projection therefrom with rotation of the shaft, and an outer ring having a gap and surrounding the rollers.

With the above construction of the support shaft, the rollers caused to roll along the inclined grooves in the longitudinal direction thereof from the deep portion toward the shallow portion thereof to progressively increase the extent of their projection therefrom with the rotation of the shaft, urge and cause expansion of the outer ring with the width of the gap increased, thereby bringing the outer ring into tight engagement either with a sheet winding section formed by winding a sheet one or more turns on the outer ring or with a core fitted thereon.

Since the rollers are surrounded by the outer ring with a gap, the support shaft according to the invention can be readily assembled and can operate reliably without being disassembled during operation. Further, since the core can precisely be locked by the outer ring with the inner periphery of the core brought into contact with the entire circumference of the outer ring, there is no fear of the core being made eccentric. Therefore, the invention can advantageously be utilized particularly in winding a sheet of a narrow width or winding a sheet into a large-diameter roll, thus completely solving the conventional problem of production of inferior goods having their end faces out of alignment due to the eccentricity of the core.

BRIEF DESCRIPTION OF THE DRAWINGS

The above and other objects and features of the invention will become more apparent from the following description with reference to the accompanying drawings in which:

FIG. 6 is a front view, partly in section, showing a third embodiment of the support shaft according to the invention;

FIG. 7 is a side view, partly in section, showing the support shaft shown in FIG. 6;

FIG. 19 is a front view, partly in section, showing an eighth embodiment of the support shaft according to the invention;

FIG. 20 is a side elevational view taken along line XX—XX in FIG. 19;

FIG. 25 is a plan view showing the support shaft shown in FIG. 23;

FIG. 26 is a fragmentary enlarged-scale sectional front view showing an eleventh embodiment of the support shaft according to the invention;

FIG. 27 is a side sectional view taken along line XXVII—XXVII in FIG. 26;

DETAILED DESCRIPTION OF THE PREFERRED EMBODIMENTS

The First Embodiment

Figure 1:
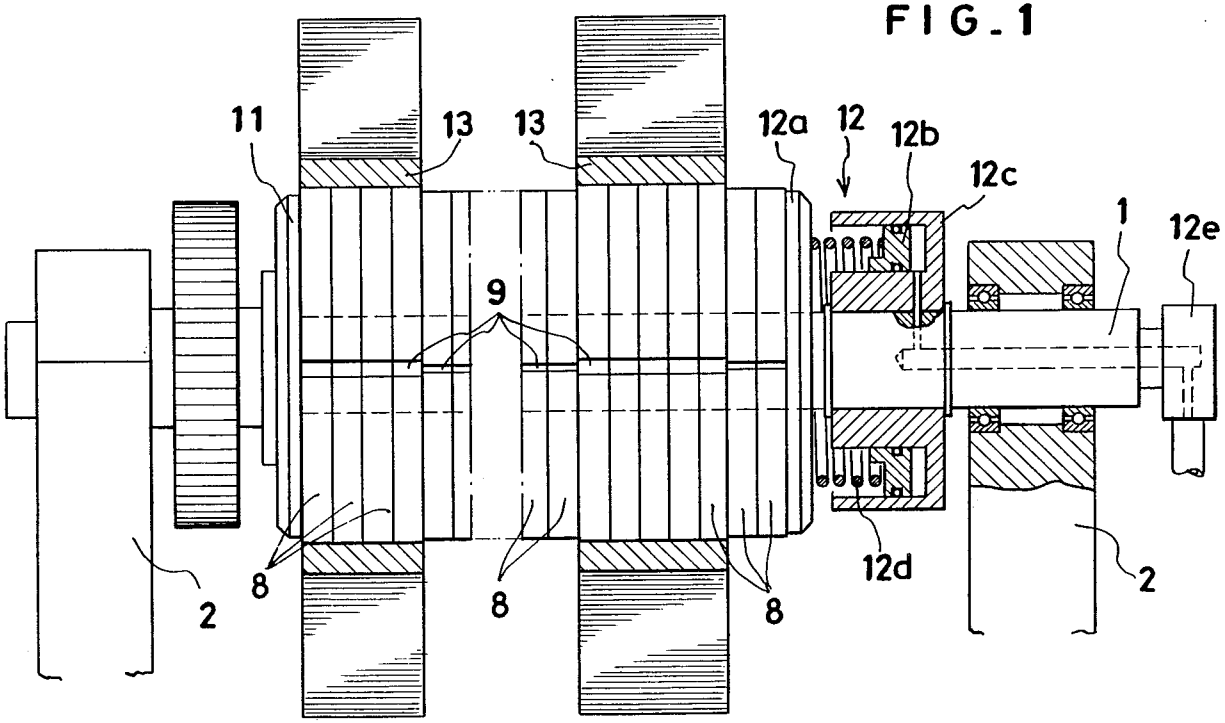
FIG. 1 is a front view, partly in section, showing a first embodiment of the support shaft according to the invention.
Figure 2:
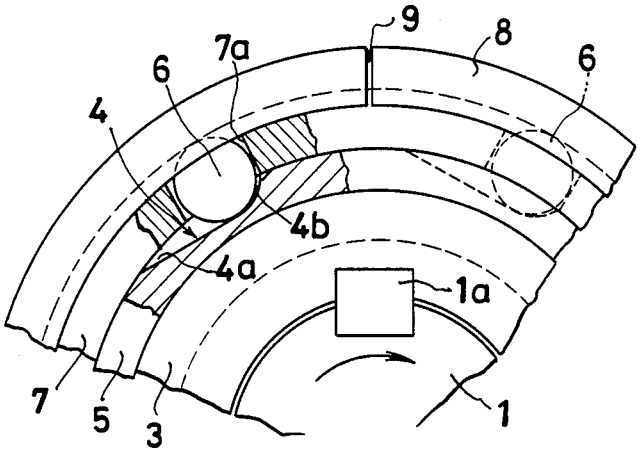
FIG. 2 is a fragmentary enlarged-scale side view, partly in section, showing an essential part of the support shaft shown in FIG. 1.
Figure 3:
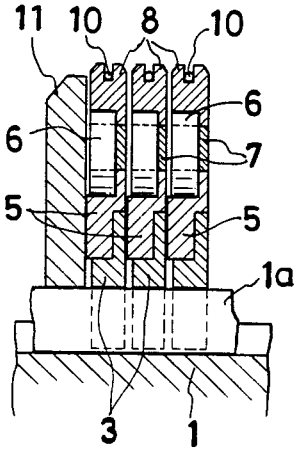
FIG. 3 is a fragmentary enlarged-scale front view, partly in section, showing an essential part of the support shaft shown in FIG. 1.
Figure 4:
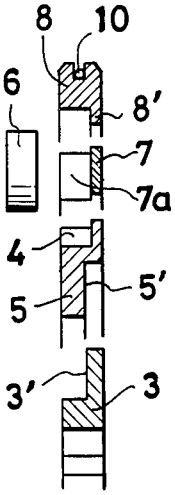
FIG. 4 is an exploded front view, partly in section, showing the part shown in FIG. 3.

FIGS. 1 to 4 show a first embodiment of the support device according to the invention. Reference numeral 1 designates a rotary shaft detachably supported between a pair of frames or arms 2 of a sheet winding machine. The shaft 1 has a gear or a chain wheel which is secured at one end of the shaft 1 and through which the rotation of the shaft 1 is transmitted. A plurality of juxtaposed thin transmission wheels 3 keyed together by keys 1*a* are rotatably mounted on the outer periphery of the shaft 1 substantially over the entire length thereof except for the opposite ends thereof rotatably supported by the arms 2. A ring 5 is fitted on the outer periphery of each of the transmission wheels 3. Each ring 5 has a plurality of, e.g., six, inclined grooves 4 uniformly spaced apart in the circumferential direction. Each inclined groove 4 has an inclined bottom. A roller 6 is partly accommodated in each of the inclined grooves 4.

Each inclined groove 4 is formed in the outer periphery of the corresponding ring 5 such that it extends in the circumferential direction. In this embodiment, the bottom of each groove 4 becomes progressively deeper from a first (shallow) end 4*a* toward a second (deep) end 4*b*. The bottom of each groove 4 need not be a flat surface as illustrated so long as its depth increases from one end toward the other end. For example, it may be curved in a convex or concave form, or it may be a succession of two or more flat surfaces having different inclination angles.

The roller 6 which is partly accommodated in each inclined groove 4 of each ring 5 is retained by a roller retainer ring 7 fitted on the outer periphery of the corresponding ring 5. An outer ring 8 with a gap 9 is fitted on each outer periphery of the roller retainer ring 7.

Each roller retainer ring 7 has pockets 7*a* which correspond in number to the number of the charried rollers 6 and which are uniformly spaced apart in the circumferential direction. Thus, the rollers 6 are held at a fixed distance from one another at all times. Each roller 6 projects to a maximum extent from the corresponding pocket 7*a* of the associated ring 7 when it is located at the shallow end 4*a* of the inclined groove 4. The extent of projection of the roller 6 from the outer periphery of the roller retainer ring 7 is reduced progressively as the roller 6 rolls along the inclined groove 4 toward the deep end 4*b*. The outer rings 8 are expanded or contracted with the rolling of the associated rollers 6 along the grooves 4. The gap 9 of each outer ring 8 thus is narrowest when the associated rollers 6 are all at the deep end 4*b* of their inclined grooves 4.

The outer rings 8 are made of an elastic material (e.g., soft steel or plastic) so that they can contract by themselves after being expanded. However, to ensure contraction of the outer rings 8, an elastically expansible member 10 may be fitted in a circumferential annular groove formed in each outer periphery of the outer ring 8. Further, each outer ring 8 may have a knurled outer peripheral surface to provide for increased friction and increased core-holding force. Each elastically expansible member 10 may be a band loop made of tenacious elastomer or a rounded piano wire. However, if a sufficiently strong contractive force of the outer rings 8 is selected, the attachment of the outer rings 8 to the core or the like may be automatically released with the rollers 6 forcibly returned to the deep ends **4*b* of the associated inclined grooves 4 by the contractive force of the outer rings 8 as soon as the rotation of the rotary shaft 1** is stopped.

In this embodiment, each set comprising a transmission wheel 3, a ring 5, a roller retainer ring 7 carrying a plurality of rollers 6, and an outer ring 8 constitute a core holder element. A plurality of these core holder elements are juxtaposedly fitted on the shaft 1 substantially over the entire length thereof except for the opposite ends as noted above. The juxtaposed core holder elements fitted on the shaft 1 are clamped by a collar 11 securely fitted on the shaft 1 and an urging unit 12 for urging all core holder elements toward the collar 11 with an adequate force provided by a spring or pressurized fluid. Each ring 5 is rotatable with its inner periphery held in frictional contact with the corresponding transmission wheel 3 and a transmission wheel axially adjacent thereto. The rollers 6, roller retainer rings 7 and outer rings 8 are arranged such that a slight gap is left between axially adjacent ones and also between the terminal one and the collar 11.

To this end, the rings 5 are made slightly thicker than the transmission wheels 3, the roller retainer rings 7 and the outer rings 8. Each transmission wheel 3 has an outer annular peripheral projection 3', and each ring 5 has an inner annular peripheral depression 5' fitting on the corresponding projection 3'. The inner portion of each ring 5 other than the inner annular peripheral depression 5' is clamped between the outer annular peripheral projection 3' of the associated transmission wheel 3 and the outer annular peripheral projection 3' of the adjacent transmission wheel 3.

Each transmission wheel 3 is preferably made of a plastic material which may or may not contain reinforcing fibers or phosphor bronze or oil-impregnated metal. The rings 5, rollers 6 and roller retainer rings 7 are preferably made of a metal, and the outer rings 8 are preferably made of either a plastic material or metal. The materials noted above are only examples and, of course, may be suitably altered.

In this embodiment, the urging unit 12 includes a movable collar **12*a* fitted for axial movement on the shaft 1, an annular cylinder 12*c* secured to the shaft 1 and provided with an annular piston 12*b* and a coil spring 12*d* provided between the piston 12*b* and the movable collar 12*a*. The corresponding end of the shaft 1 is provided with a rotary joint 12*e*. Fluid pressure is applied through the rotary joint 12*e* and a port into the annular cylinder 12*c*, so that the juxtaposed core holder elements are urged against the collar 11 by both the fluid pressure and the spring force of the coil spring 12*d***. Of course it is possible to utilize only one or the other of the spring force and the fluid pressure.

On the juxtaposed array of core holder elements there may be fitted a single core 13 having a width substantially equal to the axial length of the array or a plurality of cores 13 having a small width. Instead of using a core 13 for taking up a sheet thereon, it is possible to wind an end portion of a sheet once or several turns on the corresponding outer ring 8 and then secure the wound sheet by an adhesive or adhesive tape to form a sheet winding section. As a further alternative, an end portion of a sheet may be wound on a belt or a group of rollers surrounding the outer periphery of the corresponding outer ring.

When using the core 13, after fitting the core 13 the ends of the shaft 1 are mounted between the pair of arms 2 of the winder, and the leading end of the sheet is attached by an adhesive tape or the like to the outer periphery of the core. In the case of forming a sheet winding section or directly winding a sheet, these operations must be done after mounting the ends of the shaft between the arms 2. Afterwards, the shaft is driven for clockwise rotation in FIG. 2 to take up the sheet. The transmission wheels 3 are rotated in unison with the shaft 1, and the rings 5 begins to rotate in the same direction due to the frictional relationship with the transmission wheels 3. At this time, the rollers 6 which have been at the respective deep ends **4*b* of the associated inclined grooves 4 of the rings 5 begin to roll along the inclined grooves 4 toward the shallow ends 4*a* thereof due to the friction with the outer ring 8 produced by the tension in the sheet, thus progressively projecting from the inclined grooves 4. Each outer ring 8 surrounding the associated roller retainer ring 7 is urged radially outwardly by the rollers 6, which roll along the inclined grooves 4 toward the shallow ends 4*a* thereof and are progressively projected from the inclined grooves 4, so that the corresponding gap 9 becomes wider and wider until the corresponding outer periphery of the outer ring 8 is in tight engagement with the inner periphery of the core 13 or the sheet winding section. Once this tight engagement is attained, the outer ring 8 is rotated in unison with the associated ring 5 and also with the core 13 or the sheet winding section so that the sheet is taken up thereon. Since the rollers 6 are supported by the associated retainer ring 7 and roll on their inclined grooves 4 from the deep ends 4*b* to the shallow ends 4*a*, the associated outer ring 8 is enlarged in diameter to have its entire circumference engaged with the inner periphery of the core 13, with the result that the core 13** is not made eccentric.

In this state, the outer ring 8 of each core holder element with the core or sheet winding section thereon is in tight engagement with the inner periphery of the core 13 or sheet winding section, and the rollers 6 urging the outer ring 8 radially outwardly are located at positions immediately adjacent to the shallow ends **4*a* of the inclined grooves 4**.

The outer diameter of the outer rings 8, when the rollers 6 are at the shallow ends **4*a* of the inclined grooves 4, may be set to be greater by 10 mm, for instance, than their outer diameter assumed when the rollers 6 are at the deep ends 4*b* of the inclined grooves 4. In this case, even though the inner diameter of the cores 13 or sheet winding sections is greater by less than 10 mm than the outer diameter of the outer rings 8 when the rollers 6 are at the deep ends 4*b* of the inclined grooves 4, the cores 13** or the sheet winding sections may be coaxially supported on the drive shaft and driven smoothly for rotation.

When a predetermined length or amount of sheet has been taken up on the core 13 or sheet winding section, the rotation is stopped, and the shaft 1 is taken out from between the arms 2. Then, the obtained roll of sheet is turned together with the core 13 or sheet winding section while gripping the shaft 1 so that the rollers 6 are caused to roll toward the deep ends 4b of the inclined grooves 4. At this time, each outer ring 8 is initially rotated in unison with the core 13 or sheet winding section, causing the rollers 6 to roll along the inclined grooves 4 toward the deep ends 4b thereof. As the rollers 6 approach the deep ends 4b of the inclined grooves 4, the extent of their projection from the inclined grooves 4 is progressively reduced. Consequently, the outer rings 8 are urged radially inwardly by their own elasticity and also by the contracting force of the elastically expansible members 10 to be separated from the inner periphery of the core 13 or sheet winding section.

In this state, the shaft 1 may be withdrawn from the core 13 or sheet winding section.

In this embodiment, a plurality of narrow transmission wheels 3, rings 5, roller retainer rings 7 and outer rings 8 are juxtaposedly fitted on the shaft 1 such that the transmission wheels 3 are rotated in unison with the shaft 1 while the rings 5 are adapted to be rotated by friction in the same direction as the transmission wheels 3. Thus, a core 13 or sheet winding section having an increased width can be supported on an increased number of outer rings 8, that is, the core 13 or sheet winding section can be rotated for rotation with a predetermined take-up torque according to the width of the core 13 or sheet winding section.

In addition, the rollers 6 in contact with the corresponding outer ring 8 are uniformly spaced apart by the corresponding roller retainer ring 7, which is suitable for taking up a sheet at a high speed with less eccentricity.

Further, since in this embodiment the transmission wheels 3, rings 5, roller retainer rings 7 and outer rings 8 have small thickness, the pockets 7a and the inclined grooves 4 are open on the same side (FIG. 4), while each outer ring 8 has a radially inwardly projecting flange 8' provided on one side thereof and adapted to be in frictional contact with the outer periphery of the corresponding roller retainer ring 7 when the rollers 6 are brought to the deep ends 4b of the inclined grooves 4.

The Second Embodiment

Figure 5:
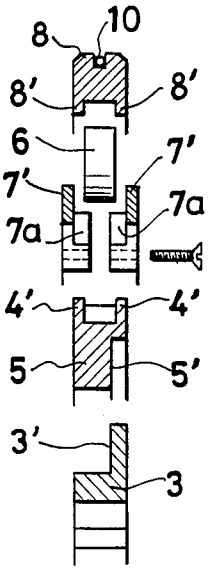
FIG. 5 is a view similar to FIG. 4 but showing a second embodiment of the support shaft according to the invention.

FIG. 5 shows a second embodiment of the invention. In this instance, the opposite sides of each inclined groove 4 and those of the corresponding pocket 7a are closed by opposed walls 4' and 7', respectively, and each outer ring 8 has a pair of radially inwardly projecting flanges 8' one of which is provided on each side. In this case, each core holder element consisting of a transmission wheel 3, a ring 5 with the grooves 4, a plurality of rollers 6, a roller retainer ring 7 and an outer ring 8 may be provided as a unit to facilitate its mounting on the shaft 1 and removal therefrom for repair. Further, each roller retainer ring 7 consists of two ring halves which are coupled together in the axial direction with bolts or by welding. The pockets 7a are defined between the two ring halves. This arrangement facilitates manufacture compared with forming pockets in a single member.

The Third Embodiment

FIGS. 6 and 7 show a third embodiment of the support shaft. This embodiment is the same as the first embodiment so far as a plurality of core holder elements each consisting of a thin ring 5, a roller retainer ring 7 and an outer ring 8 are juxtaposedly fitted on the shaft 1 over an axially intermediate portion thereof for driving cores 13 or sheet winding sections with take-up torque proportional to the width of the cores 13 or sheet winding sections. The third embodiment is different from the first embodiment in that it does not use any transmission wheels 3. Instead, each ring 5 with grooves 4 is directly fitted on the shaft 1. In addition, the shaft 1 is hollow and defines an inner space 20. The cylindrical wall of the inner space 20 is formed with a plurality of (three in this embodiment) circumferentially uniformly spaced-apart through holes 21 facing the inner periphery of each ring 5. A plunger 14 penetrates each through holes 21 for movement in the radial directions. An expansible tube 15 closed at one end is accommodated in the inner space 20 of the shaft 1. The tube 15 is expansible by fluid pressure introduced into it through a port provided in the shaft 1. With expansion of the tube 15, the plungers 14 are pushed radially outwardly, causing the outer end of the plungers 14 to push the inner periphery of the associated ring 5 to cause rotation of the ring 5 in the same direction as the rotation of the shaft 1 due to friction with the plungers 14. Slip rings 5a made of phosphor bronze, oil-impregnated metal, plastic containing carbon fiber, etc. are fitted in the inner periphery of each ring 5 so that the inner periphery of the ring 5 can smoothly slip over the outer periphery of the shaft 1. Each ring 5 has inclined grooves 4, each of which has circumferentially opposite shallow ends 4a and a central deep portion 4c. Each inclined groove 4 may be formed by removing an outer peripheral portion of the ring 5 along a plane. When cores 13 or the like are not mounted, the rollers 6 are held in the central deep portion 4c of the corresponding inclined groove 4 by the contractive force of the corresponding ring 8 as in the first embodiment. In this embodiment a magnet piece 16 is provided at the bottom of the central deep portion 4c of each inclined groove 4 to hold the associated roller 6 in the central deep portion 4c. In this embodiment, when the shaft 1 is rotated in either direction to take up a sheet, the rollers 6 on the inner periphery of the outer ring 8 with a core or sheet winding section fitted thereon are caused to roll along the inclined grooves 4 toward one of the shallow ends 4a against the attraction force of the corresponding magnetic piece 16 and the contractive force of the outer ring 8, thus urging the outer ring 8 radially outwardly into tight engagement with the inner periphery of the core 13 or sheet winding section. When the shaft 1 and the sheet roll formed thereon are rotated relative to each other to withdraw the shaft 1 from the core 13 or sheet winding section, the engagement between the core 13 or sheet winding section and the outer ring 8 is released, whereupon the rollers 6 are quickly returned to the deep central portions 4c of the inclined grooves 4 by the contractive force of the associated outer ring 8 and the attractive force of the associated magnetic piece 16. The rollers 6 are held in the central deep portions 4c of the inclined grooves 4 by the magnet pieces 16 so that they are not detached even when the outer ring 8 is removed.

In this embodiment, the urging unit of the first embodiment is unnecessary, so that the juxtaposed core holder elements may be clamped between two collars 11 secured to the shaft.

The Fourth Embodiment

Figure 9:
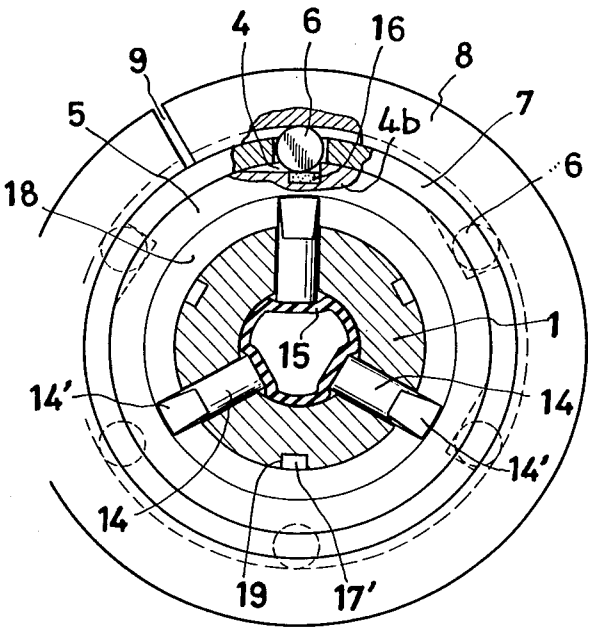
FIG. 9 is a side view, partly in section, showing the support shaft shown in FIG. 8.
Figure 8:
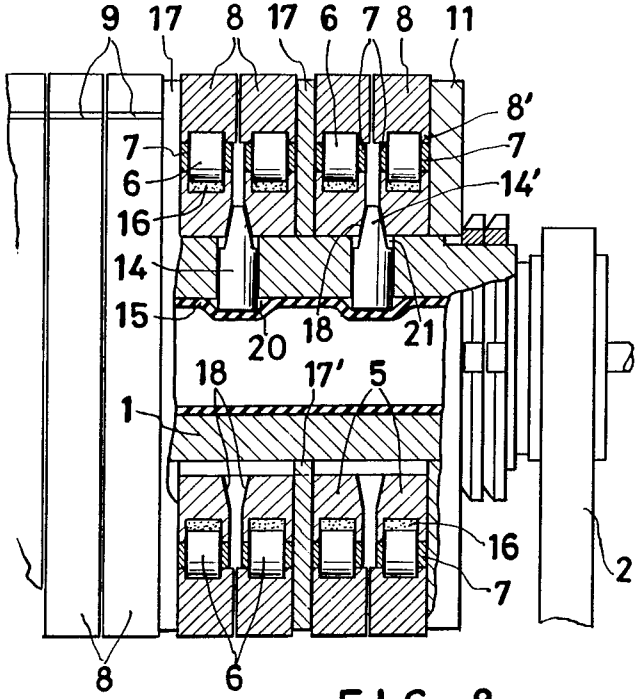
FIG. 8 is a front view, partly in section, showing a fourth embodiment of the support shaft according to the invention.

FIGS. 8 and 9 show a fourth embodiment of the support shaft according to the invention. In this embodiment, as in the preceding third embodiment, an expansible tube 15 is accommodated in the inner space 20 of the shaft 1, rings 5 are fitted directly on the shaft 1, and plungers 14 penetrate through holes 21 formed in the cylindrical wall of the shaft 1 for radially outward movement with the expansion of the tube 15 so as to cause the rings 5 to be rotated in the same direction as the shaft 1 due to friction with the plungers 14.

In this embodiment, the rings 5 are provided in pairs. The individual pairs of rings 5 are partitioned with respect to one another by annular positioning disks 17 rotated in unison with the shaft 1, the rings 5, the roller retainer rings 7 and the outer rings 8. The two rings 5 in each pair have their facing sides formed with inclined surfaces 18 formed adjacent to the inner periphery. Each plunger 14 has a wedge-like outer end 14' having opposite inclined side surfaces fitting the inclined surfaces 18 of the rings 5 in the associated pair. When the plunger 14 is pushed radially outwardly with the expansion of the tube 15, the wedge-like end 14' wedges between the associated inclined surfaces 18. Thus, each ring 5 is rotated in the same direction as the shaft by friction. In this embodiment the inclined grooves 4 in the rings each have a shallow end **4*a* and a deep end 4*b* as in the first embodiment, but a magnetic piece 16 is buried under the bottom of the deep end 4*b* of each inclined groove 4 as in the second embodiment. Further, the opposite sides of the inclined grooves 4 are closed by opposed side walls, and each outer ring 8 has radially inwardly projecting flanges 8' provided on the opposite sides. Further, the outer periphery of the shaft 1 is provided with axial grooves 19 provided at intermediate positions between circumferentially adjacent plungers 14, and the annular partitioning disks 17 have radially inward projections 17' which are received in the grooves 19 so that the partitioning disks 17 are rotated in unison with the shaft 1. The core holder elements consisting of the rings 5, the rollers 6, the roller retainer rings 7 and the outer rings 8 fitted together with the annular partitioning disks 17 on the intermediate portions of the shaft 1, are clamped between two collars 11 secured to the shaft 1. Thus, they are axially immovable. However, the annular partitioning disks 17** may be axially immovably mounted on the shaft, if necessary.

The Fifth Embodiment

Figure 10:
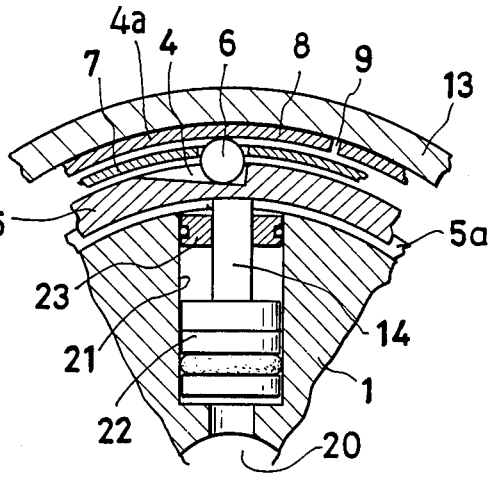
FIG. 10 is a fragmentary enlarged-scale side sectional view showing a fifth embodiment of the support shaft according to the invention.
Figure 11:
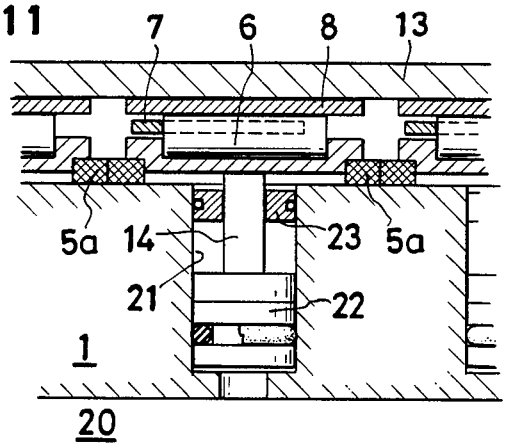
FIG. 11 is a fragmentary enlarged-scale elevational sectional view showing the support shaft shown in FIG. 10.

FIGS. 10 and 11 show a fifth embodiment of the support shaft according to the invention. In this embodiment, plungers 14 penetrating circumferentially arranged through holes 21 formed in the cylindrical wall of the shaft 1 are each provided in a radially inner portion with a piston 22 having substantially the same diameter as the corresponding through hole 21. The through holes 21 serve as cylinders, and the piston 22 in each through hole 21 is pushed by compressed air supplied into the inner space of the shaft 1. As a result, the rings 5 which are loosely fitted on the outer periphery of the shaft 1 are urged at the inner periphery by the outer end of the plungers 14 to be rotated in unison with the shaft 1.

In this embodiment, each core holder element consists of a ring 5 with inclined grooves 4 formed in its outer periphery, a roller retainer ring 7 fitted on the ring 5, rollers 6 carried by the roller retainer ring 7 and accommodated in the inclined grooves 4, and an outer ring 8 fitted on the outer periphery of the roller retainer ring 7. With the rotation of the shaft 1, each roller 6 is moved along the inclined groove 4 toward the shallow end **4*a* thereof to increase the extent of its projection. The outer ring 8 thus is expanded to urge and secure the core 13. The pressure of pressurized fluid supplied into the shaft inner space 20 may be controlled to control the urging force, i.e., frictional force, between the plungers 14 and the rings 5 so as to control the torque transmitted from the shaft 1 to the rings 5** with the driving of the shaft.

When replacing a worn-out plunger 14, the rings 5 are axially shifted until the worn-out plunger to be replaced appears, and then a retainer ring 23 provided at an end of the corresponding through hole 21 is taken out. Then, the worn-out plunger 14 can be taken out, and a new plunger 14 can be inserted.

The Sixth Embodiment

Figure 12:
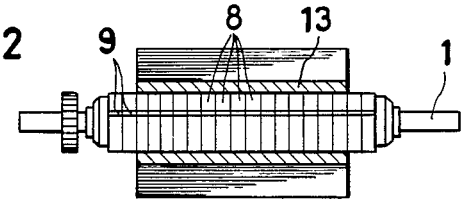
FIG. 12 is a front view, partly in section, showing a sixth embodiment of the invention.
Figure 13:
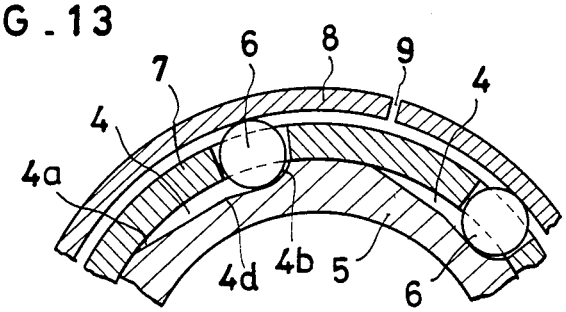
FIG. 13 is a fragmentary enlarged-scale side sectional view showing the support shaft shown in FIG. 12.

FIGS. 12 and 13 show a sixth embodiment of the support shaft according to the invention. In this embodiment, the outer periphery of a ring 5 is formed with inclined grooves 4. As shown in FIG. 13, each of the grooves 4 has a deep end **4*b*, an intermediate portion 4*d*, and a shallow-end 4*a* so that the bottom thereof has inclined surfaces in two stages. Therefore, the corresponding core 13 can be temporarily and completely locked when the roller 6 is located at the intermediate portion 4*d* and at the shallow end 4*a* of the groove 4** respectively.

First Modification of the Sixth Embodiment

Figure 14:
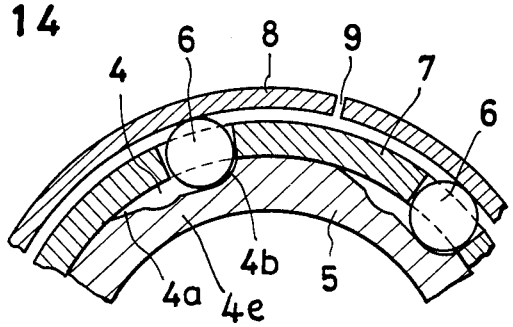
FIG. 14 is a view similar to FIG. 13 but showing a first modification of inclined grooves of the support shaft shown in FIG. 13.

FIG. 14 shows an embodiment in which each inclined groove 4 formed in a ring 5 has a recess **4*a* in an intermediate end thereof between the shallow portion 4*a* and the deep end 4*b*. When the roller 6 rolls along the inclined groove 4 from the deep end 4*b* toward the shallow end 4*a* with the relative rotation of the ring 5 and the outer ring 8, it is received in the recess 4*e*, whereby the outer ring 8 which has been slightly expanded assumes a temporarily locked state in contact with a core 13 on its outer periphery. With further rotation of the ring 5, the roller 6 escapes the recess 4*a* and rolls toward the shallow end 4*a*, thus further expanding the outer ring 8 so that the outer ring 8 is ultimately rotated in unison with the core 13**.

Second Modification of the Sixth Embodiment

Figure 15:
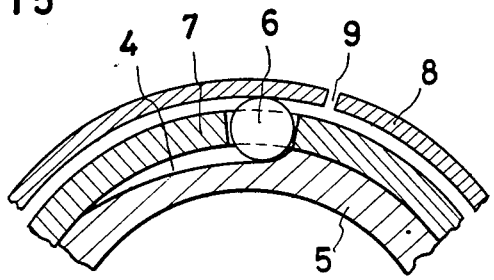
FIG. 15 is a view similar to FIG. 13 but showing a second modification of the inclined grooves of the support shaft shown in FIG. 13.

FIG. 15 shows an embodiment in which the outer periphery of a ring 5 is formed with inclined grooves 4 having a convexly arcuate sectional profile close to the arc of the outer periphery. The roller 6 is partly received in the inclined groove 4 and retained by a roller retainer ring 7 fitted on the ring 5. An outer ring 8 with a gap 9 is fitted on the roller retainer ring 7. With this structure, even when the roll of wound sheet is heavy, a force is exerted in a direction close to perpendicular, so that no substantial rewinding force is exerted.

Third Modification of the Sixth Embodiment

Figure 16:
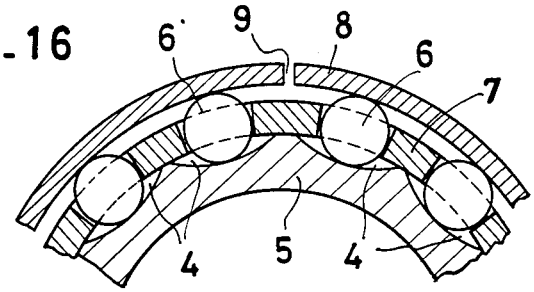
FIG. 16 is a view similar to FIG. 13 but showing a third modification of the inclined grooves of the support shaft shown in FIG. 13.

FIG. 16 shows an embodiment in which the outer periphery of the ring 5 is formed with a plurality of arcuate grooves 4, instead of inclined grooves, continuously in the circumferential direction.

Fourth Modification of the Sixth Embodiment

Figure 17:
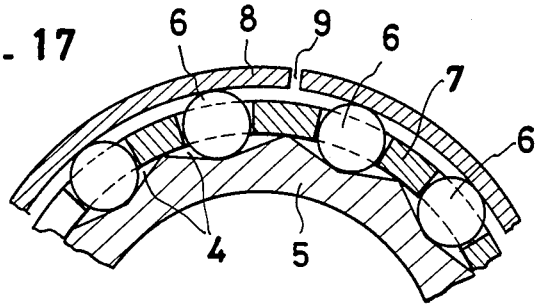
FIG. 17 is a view similar to FIG. 13 but showing a fourth modification of the inclined grooves of the support shaft shown in FIG. 13.

FIG. 17 shows an embodiment in which the outer periphery of a ring 5 is provided with a plurality of angular grooves 4 continuously in the circumferential direction. With the angular grooves 4, the extent of projection of the roller 6 from the groove 4 can be increased over that in the case of the aforesaid arcuate grooves. In addition, with the provision of an increased number of rollers 6, their area of contact with the outer ring 8 is increased. Therefore, when the weight of the sheet roll increases or when a heavy metal sheet is taken up, a reliable lock action can be obtained, which is very effective.

The Seventh Embodiment

Figure 18:
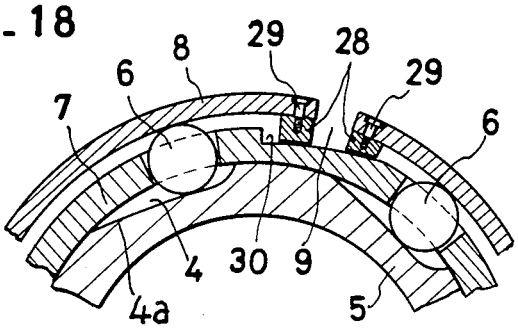
FIG. 18 is a view similar to FIG. 13 but showing a seventh embodiment of the support shaft according to the invention.

FIG. 18 shows an embodiment in which an outer ring 8 has liners 28 provided at end portions defining a gap 9. When the outer ring 8 is spread with rolling of the rollers 6 toward the shallow ends 4*a* of the grooves 4, heavy load is exerted on the ends of the outer ring 8 with the gap 9. As a result, the ends of the outer ring 8 are subject to a force tending to bend them toward the outer periphery of the roller retainer ring 7. However, the actual bending of the ends of the outer ring is prevented by the liners 28. The liners 28 may be secured by means of screws 29. The liners may be replaced with rollers, balls, etc. in view of little difference in function and effect among them. Further, the outer periphery of the roller retainer ring 7 is provided with a groove 30 which serves to maintain circularity of the outer ring 8 and control the position of the gap 9 of the outer ring 8 between the rollers 6.

When winding or unwinding a metal sheet or taking up a sheet into a large diameter roll, heavy load is inevitably exerted to result in bending of the end portions of the outer ring 8 toward the outer periphery of the roller retainer ring 7. As a result, a deviation from true circularity results, leading to a swing of the roll being wound into a complete roll or disalignment of the end faces of the roll. This is prevented by the liners 28.

Each of the above embodiments of the support shaft is of the type which penetrates the cores 13 or sheet winding sections and is mounted at its opposite ends in a pair of frames or arms 2 of a winder. These embodiments, however, are by no means limitative, and the invention is also applicable to a cup-shaped support shaft which consists of a pair of support shafts each detachably mounted in each pair of arms of a winder and inserted to a shallow extent into a core or a sheet winding section.

The Eighth Embodiment

FIGS. 19 and 20 illustrate an embodiment of the invention applied to a cup-shaped support shaft. In this instance, a considerably longer ring 5 with an outer flange 5*b* provided at one end is keyed by a key 1*a* to the outer periphery of the shaft 1. An elongate roller retainer ring 7 carrying elongate rollers 6 is fitted on the ring 5. An outer ring 8 with a gap 9 is fitted on the roller retainer ring 7. An annular retainer 24 is fitted on the ring 5 adjacent to the other end of the roller retainer ring 7 and is retained by a C-shaped clip 24*a* to prevent axial detachment of the outer ring 8 and roller retainer ring 7 from the other end of the ring 5 with the flange 5*b*.

A portion of the shaft 1 projecting from the flange 5*b* of the ring 5 is mounted in each arm of the winder. Then, each end portion of the core 13 is fitted on the outer ring 8 such that the end face is in contact with the flange 5*b*. Driving force is transmitted through a gear or a chain wheel (not shown) secured to the shaft 1 mounted in the one arm 2 of the winder.

The expansion of the outer ring 8 may be effected by causing rotation in a predetermined direction after mounting each support shaft in each arm of the winder and mounting the core 13 or sheet winding section between the pair of arms. Alternatively, each support shaft may be inserted into one end of a core or sheet winding section. Then, the core or sheet winding section and the pair of support shafts may be relatively rotated in a predetermined direction to cause the rollers to roll along the inclined grooves 4 toward the shallow ends 4*a* thereof so as to effect expansion of the outer rings 8. The resultant system may then be mounted between the pair of arms of the winder. In this embodiment, the ring 5 with the flange 5*b* and the shaft 1 are provided as separate parts. However, the two parts may be provided as an integral member.

The Ninth and Tenth Embodiments

Figure 21:
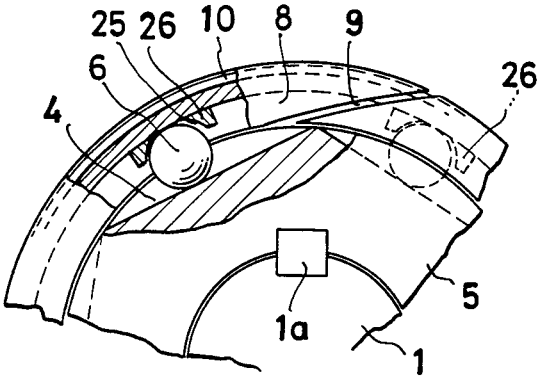
FIG. 21 is a fragmentary side view, partly in section, showing a ninth embodiment of the support shaft according to the invention.
Figure 22:
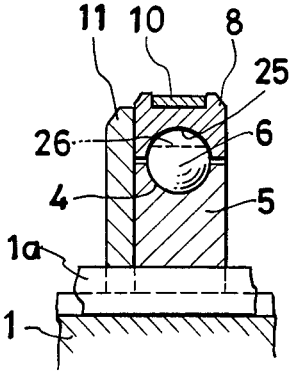
FIG. 22 is a fragmentary front view, partly in section, showing the support shaft shown in FIG. 21.
Figure 23:
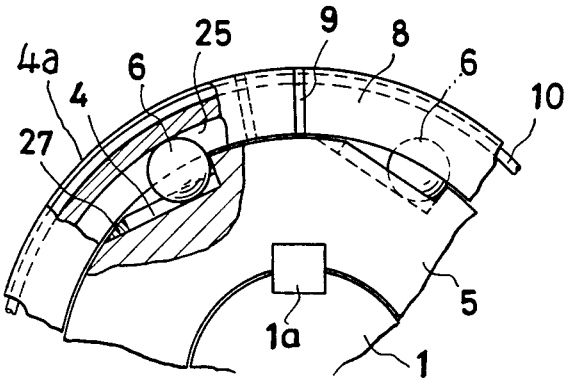
FIG. 23 is a fragmentary side sectional view, partly in section, showing a tenth embodiment of the support shaft according to the invention.
Figure 24:
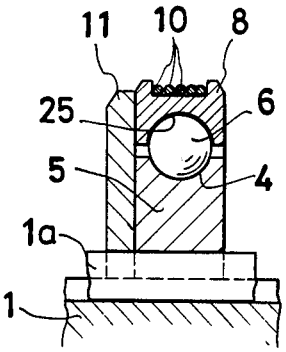
FIG. 24 is a fragmentary view, partly in section, showing the support shaft shown in FIG. 23.

FIGS. 21 and 22 show a further embodiment, and FIGS. 23 to 25 show a still further embodiment. In these embodiments of the support shaft, balls are used as the rollers 6. The inner periphery of each outer ring 8 is formed with grooves 25 having a semi-circular sectional profile, each groove 25 accommodating one half of each ball 6. In the embodiment of FIGS. 21 and 22, the outer ring 8 has ball positioners 26 secured by means of welding for positioning rollers or balls 6 in the grooves 25. The roller retainer rings 7 are thus dispensed with, and their role is served by the outer rings 8. In the embodiment of FIGS. 23 to 25, the positioners provided in the grooves 25 in the embodiment of FIGS. 21 and 22 are dispensed with, as are the roller retainer rings.

In the embodiments shown in FIGS. 1–20, the outer ring 8 has a gap 9 extending at right angles to the radial and axial directions. However, the gap 9 may be inclined only with respect to the radial direction as shown in FIG. 21 or only with respect to the axial direction as shown in FIG. 25. Further, the shallow end 4 of each inclined groove 4 may be provided with a stopper 27 for preventing detachment of the roller 6 from the inclined groove 4, as shown in FIG. 23.

The elastically expansible member 10 that is used for ensuring reliable contraction of each outer ring 8 may be a flat rubber band as shown in FIG. 22 or a plurality of parallel C clips consisting of piano wire as shown in FIGS. 24 and 25 when a wide groove is formed in the outer periphery of each outer ring 8. In the case of the C clip arrangement, the positions of gaps 10′ of the C clips may be distributed in the circumferential direction. Of course, it is possible to use as the elastically expansible member what is obtained by looping a plurality of arcuate metal pieces which are normally spring biased for contraction. In the embodiments of FIGS. 21 and 22 and FIGS. 23 to 25, each ring 5 is directly fitted on the outer periphery of the shaft 1 and keyed by the key 1*a* thereto. However, it is possible as well to allow each ring 5 to be rotated in unison with the shaft 1 by friction as in the third and fourth embodiments.

The Eleventh Embodiment

FIGS. 26 and 27 show another embodiment of the invention applied to a cup-shaped support shaft. The rollers 6 are partly accommodated in the grooves 4 formed in the outer periphery of the ring 5 with the flange 5*b* and are retained by the roller retainer ring 7. The outer ring 8 with the gap 9 is fitted on the roller retainer ring 7. In this embodiment, each outer ring 8 has two radially inwardly projecting flanges 8' to prevent axial movement of the rollers 6. The annular retainer 24 is secured by screws 24*b* to an end surface of the ring 5 to prevent detachment of the rollers 6, the roller retainer ring 7 and the outer ring 8 from the ring 5. The shaft 1 is fitted in the ring 5 and keyed by the key 1*a* thereto.

Figure 28:
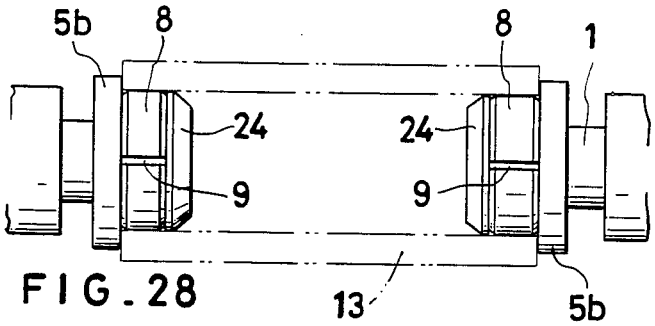
FIG. 28 is an explanatory view of a first example of how to support a core with the support shaft according to the invention.

The support shaft shown in FIGS. 23 to 25 or FIGS. 26 and 27 is inserted into each end of the core 13 as shown in FIG. 28. The pair of support shafts and the core 13 are then rotated in a predetermined direction. As a result, the rollers 6 are moved along the associated inclined grooves 4 toward the shallow ends 4*a* thereof to increase the extent of their projection from the inclined grooves 4. The associated outer ring 8 is thus spread, whereby the core 13 is reliably supported by the pair of support shafts. The support shaft shown in FIG. 27 particularly permits the core to be reliably supported with rotation in either direction.

Figure 29:
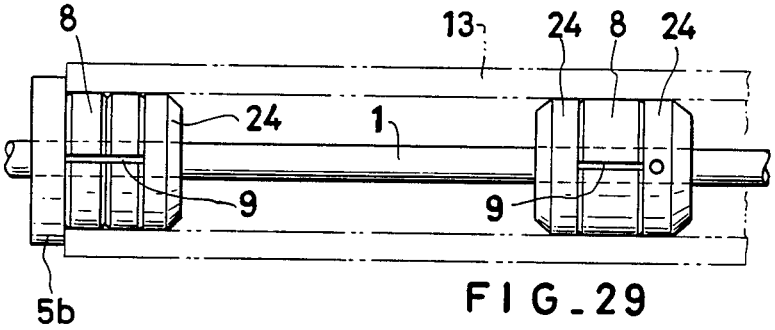
FIG. 29 is an explanatory view of a second example showing how to support a core with the support shaft according to the invention.

Second Example of Support

Where the core 13 to be supported is long, a plurality of core holder elements each consisting of the ring 5, the rollers 6 and the outer ring 8 may be provided at a suitable interval on the shaft 1 as shown in FIG. 29. If necessary, each core holder element may be held against axial movement by annular retainers 24 provided on the opposite sides. With the provision of the core holder elements on the shaft at desired positions thereof, it is possible to reliably support a core 13 having a desired length. When supporting a plurality of cores 13 on a single shaft 1, the core holder elements may each be provided on the shaft at a position thereof corresponding to a juncture between adjacent cores. Further, it is possible to support one end of the core 13 with a core holder element using the ring 5 with the flange 5*b* and the other end of the core with a core holder element using the ring 5 without any flange. In this case, when a roll of sheet of a predetermined length is completed on the core, the support shafts may be withdrawn from the sheet roll by merely releasing a lock mechanism of the core holder element.

Third Example of Support

Figure 30:
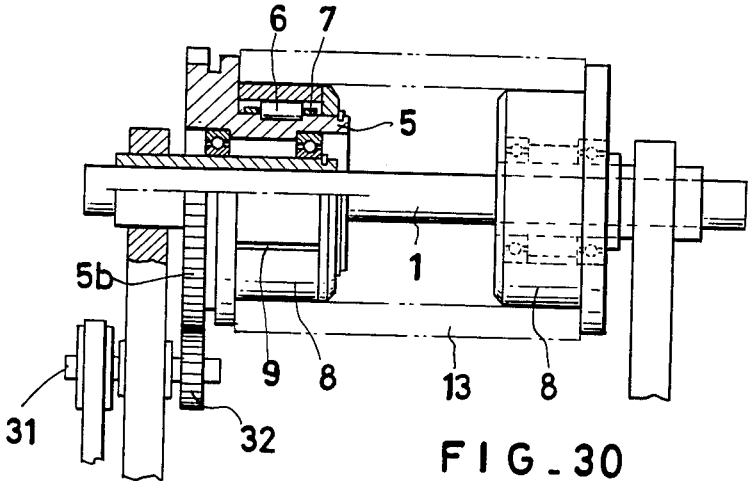
FIG. 30 is a front view, partly in section, showing a seventh embodiment of the support shaft according to the invention.

FIG. 30 shows a further embodiment in which the core holder elements are supported on a shaft 1 which is not driven. In the core holder element, a gear is provided on the outer periphery of a flange 5*b* of the ring 5. The gear is in mesh with a gear 32 secured to a drive shaft 31 which is rotated by a suitable means. With the rotation of the drive shaft 31, the ring 5 is rotated, causing movement of the rollers 6 to cause expansion of the outer ring 8 so that the core 13 is supported. In this embodiment, since the shaft 1 is not driven, it does not require precision journal finishing or like machining but merely requires such a processing as cutting of a commercially available rod to a given size.

The above embodiments are concerned with the case where one or more cores or sheet winding sections are supported between a pair of frames or arms of a winder. However, this is by no means limitative, and the invention is also applicable to a case where a core or sheet winding section for taking up a sheet thereon is supported on a cantilever frame or arm.

The inclined grooves formed in each ring are desirably uniformly spaced apart, but they may be spaced apart only substantially uniformly as well, so long as a certain distance is provided between adjacent ones of them. Further, although the rollers desirably roll accurately in the circumferential direction, they may rotate in a slightly deviated direction from the circumferential direction as well.

As has been described in the foregoing, according to the invention the rollers retained by the roller retainer ring are surrounded by an outer ring with a gap, which can be easily produced and attached. Thus, compared with the prior art arrangement using a plurality of sector-like members and elastically expansible retaining members, no complicated or difficult machining operation is needed to produce the sector-like members. Nor is the operation of coupling together the sector-like members, which are liable to come apart using expansible retaining members, needed. Thus, it is possible to reduce the labor and also the number of component parts, thus permitting reduction of the price of the product. Further, unlike the prior art case, there is no possibility of detachment of a sector-like member during the rotation of the shaft which has made it inevitable to suspend the operation or caused scattering of detached sector-like members in places other than the place of the core. Besides, the same effects as in the case of using the sector-like members can be obtained in the function of locking the core or the like with an expansive force. Further, since substantially the entire area of the outer periphery of the outer ring is in contact with the inner periphery of the core or the like, the contact area is large, so that it is possible to eliminate eccentricity of the core and reduce the surface pressure. Therefore, there is no possibility of partial intrusion of the outer ring into the inner periphery of the core or the like to cause deformation thereof even in the case of a so-called friction type winding shaft where a sheet is taken up with a large torque on a paper tube or like core having comparatively low mechanical strength. Further, according to the invention, there is provided an arrangement for locking a core such as a paper tube in two stages with expansive force. That is, in the first stage expansion is brought about either manually or automatically after the setting of the core to effect a temporary locking of the core. Subsequently, when the support shaft is rotated for the winding of a sheet, the second stage of expansion is brought about to sufficiently lock the core. Thus, the operability is extremely improved, and preparation for the start of operation can be carried out quickly. Further, with the provision of inclined grooves having convex arcuate profile close to the arc of the outer periphery of the support shaft in the two-stage lock arrangement, a force is applied nearly in the perpendicular direction as returning force to a sheet roll even in case where the sheet roll is heavy, which is very effective when a heavy metal sheet is taken up or when a sheet is taken up into a large sheet roll.

Further, for locking the core or the like with expansive force, the inclined grooves and the rollers may be provided in number corresponding to the weight of the sheet roll to be produced. By increasing the inclined grooves and rollers, the outer ring with the gap can be supported by rollers at points spaced apart at a reduced interval. This has an effect of permitting expansion of the outer ring while maintaining the true circularity and without causing any deformation.

It is to be emphasized that according to the invention the rollers retained by the roller retainer member are surrounded by an outer ring with a gap which can be readily produced and attached. Thus, unlike the prior art construction using a plurality of sector-like members and expansible retaining members, neither the complicated and difficult operation of machining to produce sector-like members nor the operation of coupling together the sector-like members, which are readily liable to come apart using expansible retaining members, is necessary, thus permitting the reduction of labor and of the number of components to reduce the price of the product. Further, there is no possibility of detachment of any sector-like member during rotation of the shaft, which in the past has made it inevitable to interrupt the operation, or caused scattering of detached sector-like members in places other than where there is a core. Furthermore, since there is no possibility of the core being made eccentric, the end faces of a roll of sheet can be precisely aligned even in winding a sheet of a small width on the core or in winding a sheet into a large-diameter roll, thus enabling good-quality products to be obtained.

What is claimed is:

1. A support shaft for friction winding/unwinding sheets, said support shaft comprising:

(a) a drive shaft;

(b) a plurality of rings juxtaposedly and rotatably fitted on said drive shaft, each one of said plurality of rings having the upper periphery thereof formed with a plurality of circumferentially inclined grooves circumferentially spaced apart, each one of said inclined grooves having an inclined bottom;

(c) torque transmitting means for transmitting torque from said drive shaft to each one of said plurality of rings;

(d) rollers accommodated in said inclined grooves for rolling therein from a deep portion thereof toward a shallow portion thereof to progressively increase the extent of projection therefrom with a rotation of said plurality of rings;

(e) space holding means provided near said plurality of rings for holding said rollers spaced apart in the circumferential direction of said plurality of rings in engagement of said rollers during rolling thereof; and (f) a plurality of outer rings, each one of said plurality of outer rings having a gap and at least one flange projecting therefrom radially inwardly along an end face of a corresponding one of said rollers, each one of said plurality of outer rings being fitted on a corresponding one of said plurality of rings to surround the outer surfaces of the associated ones of said rollers and being capable of being expanded by the urging force of said rollers.

2. The support shaft according to claim 1, wherein each of said inclined grooves has a shallow portion adjacent to one end in the circumferential direction and a deep portion adjacent to the other end.

3. The support shaft according to claim 1, wherein each of said inclined grooves has shallow portions adjacent to opposite ends in the circumferential direction and a deep portion at the center.

4. The support shaft according to claim 1, wherein each of said inclined grooves has a convex arcuate sectional profile close to the arc of the outer periphery of the support shaft.

5. The support shaft according to claim 1, wherein each of said inclined grooves has a bottom constituted by two different inclined flat surfaces.

6. The support shaft according to claim 1, wherein said inclined grooves are arcuate grooves with the bottoms thereof inclined in the circumferential direction and having an arcuate sectional profile.

7. The support shaft according to claim 1, wherein said inclined grooves are angular grooves with the bottoms thereof inclined in the circumferential direction and having an angular sectional profile.

8. The support shaft according to claim 1, wherein said outer rings have liners provided on opposite end portions defining said gap in each one of said outer rings.

9. The support shaft according to claim 1, wherein each one of said plurality of outer rings has two flanges projecting therefrom radially inwardly along opposite end faces of a corresponding one of said rollers so as to interpose part of said corresponding one of said rollers therebetween.

10. In a shaft for winding/unwinding sheets, in which a drive shaft has the outer periphery thereof formed with a plurality of circumferentially inclined grooves circumferentially spaced apart and having an inclined bottom and rollers are accommodated in respective ones of said inclined grooves for rolling therein from a deep portion toward a shallow portion thereof to progressively increase the extent of projection thereof with a rotation of said shaft, thereby effecting the winding-/unwinding of sheets, an improvement of said shaft wherein the outer surface of said rollers are surrounded by an outer ring having a gap and also having radially inwardly projecting flanges provided on opposite end faces of each one of said rollers.

* * * * *